US006520280B2

(12) United States Patent
Moskowitz

(10) Patent No.: US 6,520,280 B2
(45) Date of Patent: Feb. 18, 2003

(54) SYSTEM AND METHOD FOR WORKSPACE SOUND REGULATION

(75) Inventor: Paul Andrew Moskowitz, Yorktown Heights, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/772,862

(22) Filed: Jan. 31, 2001

(65) Prior Publication Data

US 2002/0100634 A1 Aug. 1, 2002

(51) Int. Cl.[7] ..... E04B 1/99
(52) U.S. Cl. ..... 181/30; 181/143; 181/153
(58) Field of Search ..... 181/30, 143, 153, 181/155

(56) References Cited

U.S. PATENT DOCUMENTS 1,120,858 A * 12/1914 Stallforth ..... 181/30
3,410,363 A * 11/1968 Schwartz ..... 356/450
4,856,242 A * 8/1989 Baloga et al. ..... 52/239
5,159,893 A 11/1992 Rantanen ..... 118/227
5,268,539 A 12/1993 Ono ..... 181/155
5,298,494 A 3/1994 Arora et al. ..... 514/23
5,532,438 A 7/1996 Brown ..... 181/155
5,848,169 A 12/1998 Clark, Jr. et al. ..... 381/71.13
5,850,060 A 12/1998 Gerber et al. ..... 181/175

FOREIGN PATENT DOCUMENTS

JP 2000287757 * 10/2000

* cited by examiner

*Primary Examiner*—Shih-Yung Hsieh
(74) *Attorney, Agent, or Firm*—Stephen C. Kaufman, Esq.; McGinn & Gibb, PLLC

(57) ABSTRACT

A system (and method) for workspace sound regulation, includes an office enclosure having a plurality of barriers, the barriers including reflective surfaces, and the reflective surfaces creating a plurality of preferred locations in the enclosure.

16 Claims, 3 Drawing Sheets

SYSTEM AND METHOD FOR WORKSPACE SOUND REGULATION

BACKGROUND OF THE INVENTION

1. Field of the Invention

The present invention generally relates to a novel workspace arrangement (and method therefor), and more particularly to a workspace arrangement in which the sound therein is regulated.

2. Description of the Related Art

A major complaint voiced by office workers about the work environment is that the level of sound or noise is too high. This is particularly the case for the modular office or cubicle, in which typically a high density of employees is found.

Typically, such cubicles allow sound to pass from one cubicle to another cubicle. Conversations must be raised to compensate for the background noise. This then adds to the overall noise level, thereby making it difficult for a worker to concentrate, conduct business on the telephone, etc.

Steps to alleviate the problem have included placing sound insulation in walls and partitions or lining them with sound stopping materials such as steel, or creating a white noise background to mask conversations.

SUMMARY OF THE INVENTION

In view of the foregoing drawbacks, disadvantages, and problems of the conventional arrangements, it is an object of the present invention to provide a structure and method for minimizing sound in a workspace environment.

Another object is to minimize sound in a workspace environment by creating offices and cubicles in the shape of an ellipse.

In a first aspect, a system includes a workspace enclosure having a plurality of barriers, the barriers including reflective surfaces, the reflective surfaces creating a plurality of preferred locations in the enclosure.

In a second aspect, a method of designing a workspace enclosure includes creating a workspace enclosure having a plurality of barriers, the barriers including reflective surfaces, the reflective surfaces creating a plurality of preferred locations in the enclosure.

Thus, the invention provides a novel arrangement taking advantage of an elliptical configuration. The ellipse is known to have two foci such that any sound which passes through one focus then passes through the second focus after reflection. Certain public buildings, either through design or accident, have sound focusing properties including the dome of St. Paul's Cathedral in London designed by Wren, the National Statuary Hall of the U.S. Capitol, etc. In an elliptical arrangement, the foci have preferred positions with respect to sound pressure.

In one embodiment of the invention, the workspace enclosure (home or at a place of business) is designed so that an occupant is seated with his head at one focus of the enclosure and a guest is seated with his head at the other focus of the enclosure. Conversational sound will be preferentially directed from one focus to the other enhancing the sound level of the conversation over that of the background sound level, thereby allowing the two occupants to converse in low amplitude voices.

In another embodiment of the invention, a single occupant of the enclosure is seated so that his head is at one focus of the enclosure and a sound absorbing system (passive or electronic) is placed at the other focus so as to lower the sound pressure experienced by the occupant.

Additionally, the work surface of the occupant may be placed at one focus and an illumination source may be placed at the focus so that the light of the illumination source is preferentially directed to the work surface. Also, such offices may be grouped in geometric or other groupings.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF PREFERRED EMBODIMENTS OF THE INVENTION

Referring now to the accompanying drawings, a detailed description will be given of the embodiments of the present invention.

Figure 1:
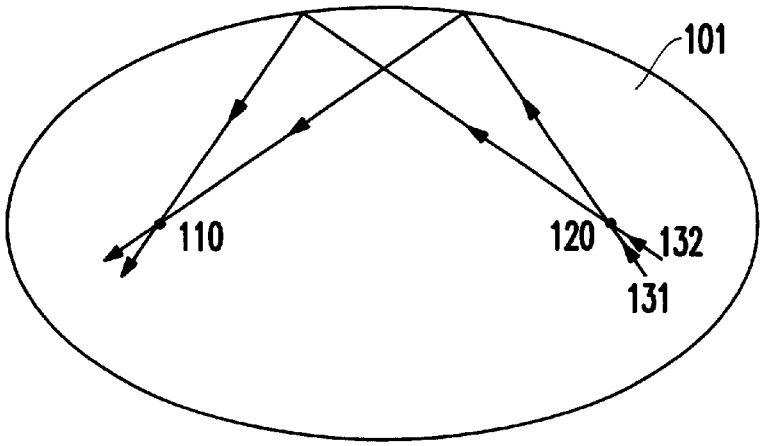
FIG. 1 illustrates the basic principle of the invention.

FIG. 1 illustrates the basic principle of the present invention. An elliptical reflective surface 101 which forms the wall of an office workspace is shown from above. It has two foci 110, 120. If any energy propagating waves such as light, infrared, sound waves 131 and 132 or the like traverse one focus 120, the infrared, light, sound waves or the like are reflected by the inner surface of the ellipse 101, and reach the other focus 110. The geometry is such that any waves that pass near the focus 120 will be reflected to pass near the other focus 110. In the context of the present application, "focus" means the focal point and an area adjacent to the focal point. The extent of the adjacent area will depend on the quality of the enclosure (e.g., the degree of perfection of the elliptical surfaces and the degree to which other items placed within the enclosure tend to spread reflected waves).

It is noted that the reflective surfaces may be curved surfaces (e.g., continuously curved) or may be flat surfaces arranged to approximate a curve (e.g., arranged in their totality to form an elliptical shape). The enclosure may be created with only a part formed by curved elliptical surfaces. In that case, the desired effect will still be present but reduced in efficiency.

If a source for producing sounds is placed at the focus 120, sounds or the like produced reach the one focus 110. If a mechanism for absorbing sound waves or for canceling sound waves is placed at the first focus 120, then any sound wave that would have reached the focus 110 after having passed through the focus 120 is now eliminated.

It is noted that while workspace configurations are shown in the figures, the invention is equally applicable to a place-of-business or home arrangement.

Figure 2:
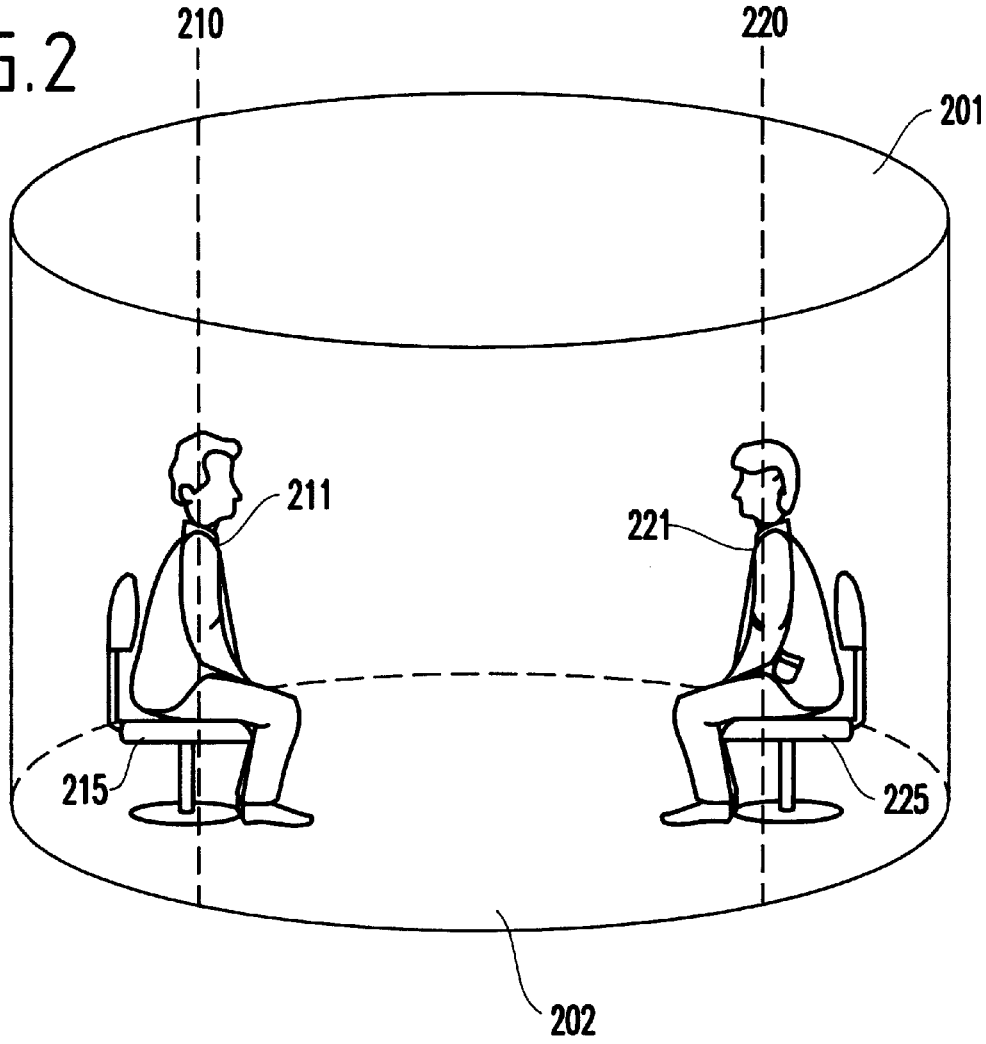
FIG. 2 illustrates the placement of seats 215, 225 in a workspace to enhance conversational levels.

FIG. 2 illustrates the placement of seats 215, 225 in a workspace to enhance conversational levels. The workspace space of FIG. 2 is constructed of elliptical walls 201 extending upward from the floor 202 to form a cylindrically symmetric elliptical enclosure. Ideally, the walls are completely reflective, in which case the invention works at its most optimum level. If the walls are not perfectly reflective because there are objects on the walls, or furniture scatters the reflections, etc., then the focus will be spread over a larger area. The walls may be extended from floor to ceiling to create a workspace which is an office (enclosed office), or may be only partially extended from the floor to form a cubicle workspace. Typical cubicle walls are 4 to 6 feet in height.

Seats 215 and 225 preferably are placed such that the heads of persons 211 and 221 are located respectively at the foci 210 and 220 of the enclosure. As a result of the principle illustrated in FIG. 1, sound waves (e.g., conversation produced at the head of person 211) are preferentially focused at the head of person 221 and vice versa. This conversation may be carried on at a reduced intensity level, assuring privacy for the persons 211 and 221 and reducing the sound level heard by persons in adjoining enclosures. An array of enclosures will be shown in FIG. 5. It is understood that the workspace has a doorway built into the wall of the enclosure and may have the standard office work surfaces, shelves, storage areas, etc.

As alluded to above, added items (e.g., furniture, draperies, wall hangings, etc.) in the workspace will tend to scatter sound and may change the effectiveness of the design. The elliptical shape need not be perfect, but may be composed of flat surfaces approximating an ellipse.

Figure 3:
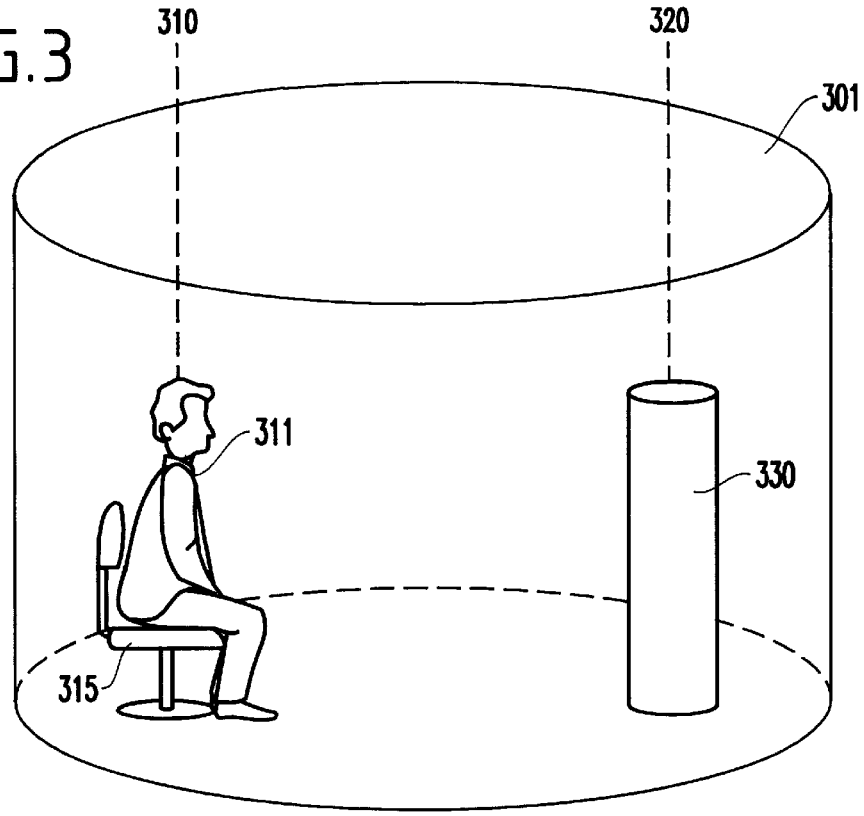
FIG. 3 illustrates the placement of sound-absorbing apparatus 330 in the workspace.

FIG. 3 illustrates the placement of an apparatus 330 within an elliptical enclosure 301. As in the previous arrangement of FIG. 2, a person 311 is seated on a seat 315 placed so that the person's head is at the one focus 310 of the workspace. An apparatus for reducing sound 330 is placed at the other focus 320 of the enclosure.

The apparatus may include passive sound absorbing material such as that described in U.S. Pat. No. 5,298,694 issued to Thompson et al., incorporated herein by reference, or may be an active sound cancellation device as described in U.S. Pat. No. 5,559,893 issued to Krokstadt et al., or in U.S. Pat. No. 5,848,169 issued to Clark and Cole, both incorporated herein by reference. The result of placing the sound absorbing or canceling apparatus at the focus 320 is to reduce the sound level at the focus 310 where the head of the person 311 is located. All sound that enters the enclosure that without the apparatus would travel through the focus 320 and by reflection to the focus 310 is now eliminated or reduced.

The apparatus 330 may include a heater such as an electrical heater which emits infrared (heat) waves. The infrared waves will be reflected to the focus 310 to warm the area where the occupant is located.

Figure 4:
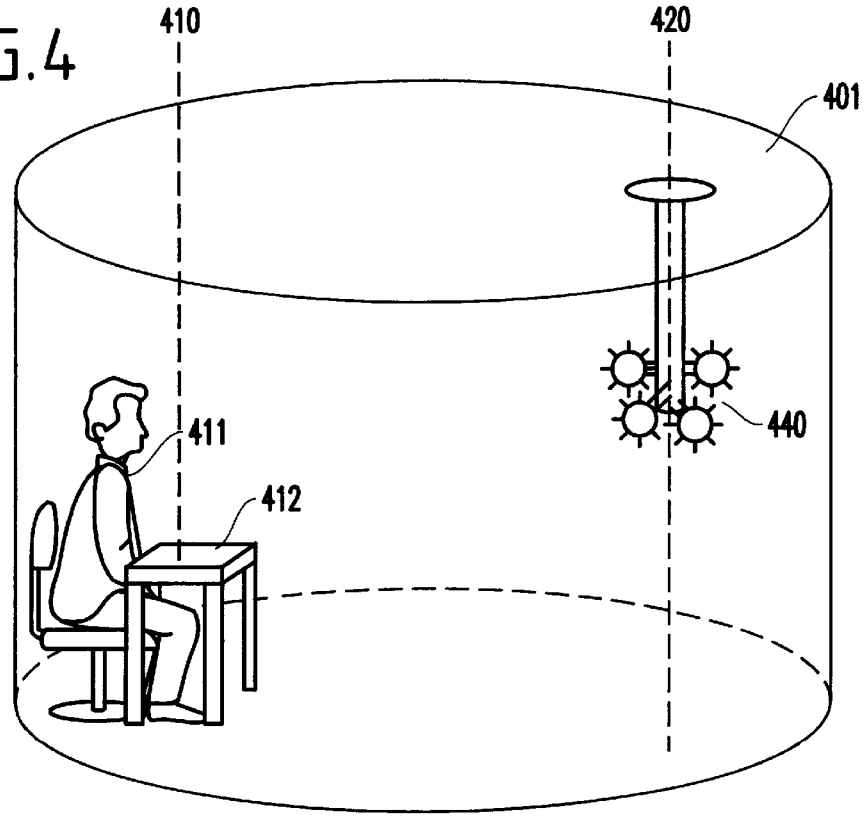
FIG. 4 illustrates the use of an elliptical enclosure to enhance the lighting for an individual workspace.

FIG. 4 illustrates the placement of a work surface (e.g., desk) 412 at the first focus of the elliptical enclosure 401, while an illumination source 440 is placed at the second focus 420. The light coming from the illumination source is preferentially reflected by the walls of the enclosure 401 to the work surface 412.

Figure 5:
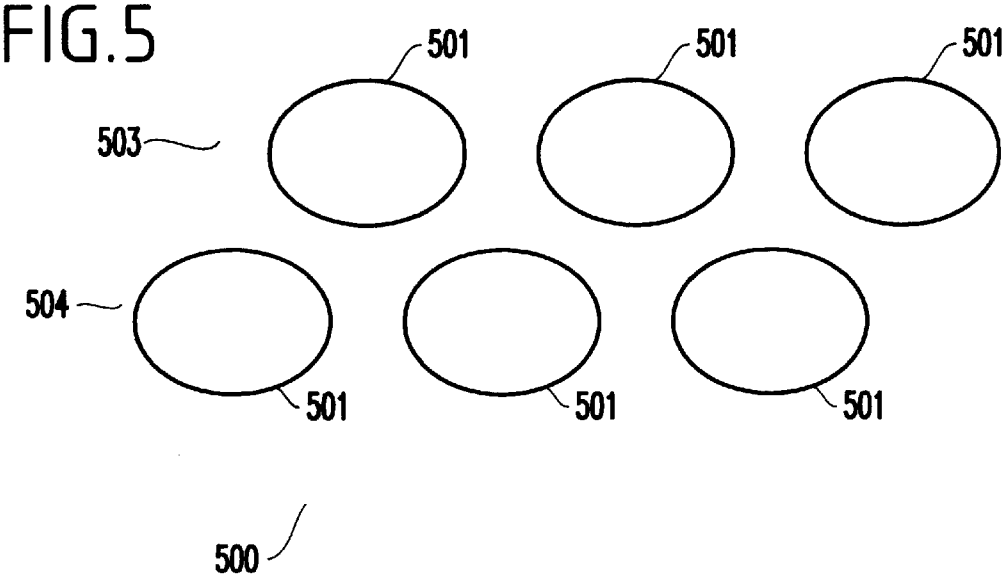
FIG. 5 illustrates an array 500 of workspaces.

FIG. 5 illustrates an array 500 of workspaces 501 arranged in two rows 503 and 504. The effect of a multiple array of such workspaces 500, one or more of which is designed as previously described, will be to reduce the overall sound levels for the entire workplace. The two rows shown form the first two rows of an hexagonal close-packing (hcp) arrangement. Other geometries that may be used are rectangular arrays, circular arrays, arcs of circular arrays or any other appropriate geometry.

Figure 6:
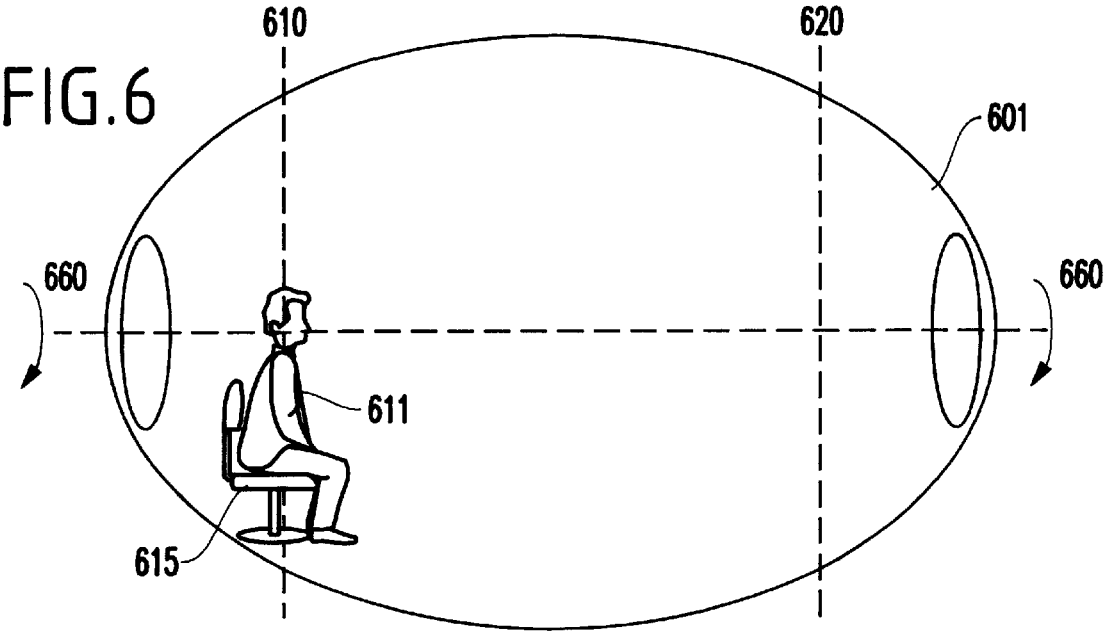
FIG. 6 illustrates an alternative shape for the enclosure.

FIG. 6 illustrates an alternative shape for the enclosure 601. Rather than having a cylindrical symmetry as shown in FIGS. 2, 3, and 4, the workspace enclosure is "egg" shaped where the walls are formed, not by extending an elliptical shape vertically along a vertical axis as in FIGS. 2–4, but by rotating an elliptical shape about a horizontal axis 660. Here the geometric arrangement is such that the head of the seated occupant 611 is located not only at the focus of ellipse 610, but also along the axis of rotation 660.

With the unique and unobvious features of the invention, a novel arrangement is provided which takes advantage of an elliptical configuration. Hence, the invention advantageously uses the elliptical arrangement, in which the foci have preferred positions with respect to sound pressure.

Thus, in the first embodiment, with an occupant seated with his head at one focus of the enclosure and a guest seated with his head at the other focus of the enclosure, conversational sound is preferentially directed from one focus to the other, thereby enhancing the sound level of the conversation over that of the background sound level, and thereby allowing the two occupants to converse in low amplitude voices.

In the second embodiment of the invention, a single occupant of the enclosure is seated so that his head is at one focus of the enclosure and an apparatus, a sound absorbing system (passive or electronic) is placed at the other focus so as to lower the sound pressure experienced by the occupant. Additionally, as noted above, the work surface of the occupant may be placed at one focus and an illumination source may be placed at the other focus, so that the light of the source is preferentially directed to the work surface. Additionally, a heater which is a source of infrared heat waves may be placed at the second focus to warm an occupant located at the first focus. Also, such office workspaces may be grouped in geometric or other groupings.

Additionally, the present invention is directed to a method of creating a workspace using the invention described above. Such creating includes designing, fabricating, marketing, and installing such a workspace.

While the invention has been described in terms of preferred embodiments, those skilled in the art will recognize that the invention can be practiced with modification within the spirit and scope of the appended claims.

What is claimed is:

1. A system comprising:

a workspace enclosure having a plurality of barriers and substantially completely surrounding the workspace, said workspace enclosure being designed to contain no more than first and second occupants being in communication with one another, and wherein said workspace enclosure includes an office cubicle including a plurality of walls and a floor coupled to said walls, said barriers being reflective surfaces, said reflective surfaces creating a plurality of preferred locations in the enclosure, wherein said enclosure completely surrounds said first and second occupants of said enclosure, wherein said preferred locations comprise a first focus and a second focus of an ellipse, and wherein a seating position of said first occupant of said enclosure is substantially located at said first focus and a seating position of said second occupant is position at said second focus, to allow direct communication between said first and second occupants of said enclosure.

2. The system of claim 1, wherein said reflective surfaces comprise curved surfaces.

3. The system of claim 2, wherein said curved surfaces comprise elliptical curves.

4. The system of claim 2, wherein said preferred locations comprise a first focus and a second focus of an ellipse.

5. The system of claim 1, wherein said first focus has a work surface thereat and said second focus has a light source placed thereat.

6. The method of claim 1, wherein a plurality of ones of said enclosure are placed in one of a rectangular array, a hexagonal array, a circular array, an arc of a circular array, and another-shape geometric array.

7. The system of claim 1, wherein said reflective surfaces comprise flat surfaces approximating a curve.

8. An arrangement for regulation of energy propagating waves, comprising:

an enclosure having a plurality of barriers and substantially completely surrounding an object in the enclosure, said enclosure being designed to contain no more than first and second occupants being in communication with one another, and wherein said enclosure includes an office cubicle including a plurality of walls and a floor coupled to said walls, said barriers including curved surfaces, said curved surfaces creating a plurality of preferred locations in the enclosure, wherein said enclosure completely surrounds said first and second occupants of said enclosure, wherein said preferred locations comprise a first focus and a second focus of an ellipse, and wherein a seating position of said first occupant of said enclosure is substantially located at said first focus and a seating position of said second occupant is position at said second focus, to allow direct communication between said first and second occupants of said enclosure.

9. The arrangement of claim 8, wherein said energy propagating waves comprise any of sound waves, infrared waves, and light waves.

10. A method, comprising:

creating a workspace enclosure having a plurality of barriers and substantially completely surrounding the workspace, said barriers including reflective surfaces, said reflective surfaces creating a plurality of preferred locations in the enclosure, said workspace enclosure being designed to contain no more than first and second occupants being in communication with one another, and wherein said workspace enclosure includes an office cubicle including a plurality of walls and a floor coupled to said walls, wherein said enclosure completely surrounds said first and second occupants of said enclosure, wherein said preferred locations comprise a first focus and a second focus of an ellipse, and wherein a seating position of said first occupant of said enclosure is substantially located at said first focus and a seating position of said second occupant is position at said second focus, to allow direct communication between said first and second occupants of said enclosure.

11. The method of claim 10, wherein said reflective surfaces comprise curved surfaces.

12. The method of claim 11, wherein said curved surfaces comprise elliptical curves.

13. The method of claim 10, wherein said first focus has a work surface thereat and said second focus has a light source placed thereat.

14. The method of claim 10, wherein a plurality of ones of said enclosure are placed in one of a rectangular array, a hexagonal array, a circular array, an arc of a circular array, and another-shape geometric array.

15. A method of sound regulation, comprising:

creating a workspace enclosure having a plurality of barriers and substantially completely surrounding the workspace, said workspace enclosure being designed to contain no more than first and second occupants being in communication with one another, and wherein said workspace enclosure includes an office cubicle including a plurality of walls and a floor coupled to said walls, said barriers including reflective surfaces, said reflective surfaces creating a plurality of preferred locations in the enclosure, wherein said enclosure completely surrounds said first and second occupants of said enclosure, wherein said preferred locations comprise a first focus and a second focus of an ellipse, and wherein a seating position of said first occupant of said enclosure is substantially located at said first focus and a seating position of said second occupant is position at said second focus, to allow direct communication between said first and second occupants of said enclosure.

16. A system comprising:

a workspace enclosure having a plurality of barriers and substantially completely surrounding the workspace, said barriers being reflective surfaces, said reflective surfaces creating a plurality of preferred locations in the enclosure, said workspace enclosure being designed to contain only first and second occupants being in communication with one another, and wherein said workspace enclosure includes an office cubicle including a plurality of walls and a floor coupled to said walls, wherein said preferred locations comprise a first focus and a second focus of an ellipse, and wherein a seating position of said first occupant of said enclosure is substantially located at said first focus, and a seating position of said second occupant is substantially located at said second focus, to allow for direct communication between said first and second occupants.

* * * * *